US007008190B2

(12) United States Patent
Brault et al.

(10) Patent No.: US 7,008,190 B2
(45) Date of Patent: Mar. 7, 2006

(54) TURBOMACHINE ROTOR ARRANGEMENT

(75) Inventors: Michel Gilbert Roland Brault, Boussy Saint Antoine (FR); Laurent Luc Arnaud Palmisano, Yerres (FR)

(73) Assignee: Snecma Moteurs, Paris (FR)

( * ) Notice: Subject to any disclaimer, the term of this patent is extended or adjusted under 35 U.S.C. 154(b) by 292 days.

(21) Appl. No.: 10/346,134

(22) Filed: Jan. 17, 2003

(65) Prior Publication Data

US 2003/0133803 A1 Jul. 17, 2003

(30) Foreign Application Priority Data

Jan. 17, 2002 (FR) ..... 02 00522

(51) Int. Cl.
*F01D 5/02* (2006.01)

(52) U.S. Cl. ..... 416/198 A; 416/204 A

(58) Field of Classification Search ..... 416/194, 416/198 A, 201 R, 204 A, 214 A, 219 R, 416/220 R, 244 A
See application file for complete search history.

(56) References Cited

U.S. PATENT DOCUMENTS 2,773,667 A 12/1956 Wheatley
2,825,124 A 3/1958 Nichols et al.
2,861,823 A * 11/1958 Perry ..... 416/135
2,869,820 A * 1/1959 Marchant et al. ..... 416/201 R
3,295,825 A * 1/1967 Hall, Jr. ..... 416/221
3,868,197 A 2/1975 Hugoson

FOREIGN PATENT DOCUMENTS

| | | |
|---|---|---|
| FR | 902 004 | 8/1945 |
| FR | 1 057 171 | 12/1956 |
| FR | 1 534 718 | 3/1958 |
| FR | 1 201 123 | 12/1959 |
| FR | 1 201 124 | 12/1959 |

OTHER PUBLICATIONS

European Search Report (EP 03 29 0117), Apr. 22, 2003, 2 pages.

* cited by examiner

*Primary Examiner*—Edward K. Look
*Assistant Examiner*—Richard A. Edgar
(74) *Attorney, Agent, or Firm*—Oblon, Spivak, McClelland, Maier & Neustadt, P.C.

(57) ABSTRACT

In a succession of rotor disks, only the end disks are connected to a main structure by bolted extensions and the intermediate disks are suspended from rigid spacer pieces by centering and anti-rotation connections. The end disks are interconnected to clamp the assembly in the axial direction. There is no bolted connection between the successive disks. Assembly is very easy. The disks and the spacer pieces are stacked together in alternately, and the assembly is torsionally very rigid because of the use of a high number of claw-coupling teeth formed by protruding ends of the blade roots forming teeth that engage in spacer piece end rims.

21 Claims, 3 Drawing Sheets

TURBOMACHINE ROTOR ARRANGEMENT

BACKGROUND OF THE INVENTION

The subject of this invention is a turbomachine rotor arrangement.

Such rotors often comprise individual disks bearing rotor-blade stages and joined by spacer pieces. The main purpose of the spacer pieces is to provide seals restricting the flow of gases between the stages. The disks normally have extensions that extend towards a central structure of the rotor to which they are fixed by bolts. They also comprise rims that extend under the spacer pieces and are joined together by bolts at their ends. Each disk is thus connected directly to adjacent disks, in addition to having an indirect connection via the central structure of the rotor. However, it is found that this arrangement is not as rigid as may have been hoped, something which is all the more disappointing since all these bolted connecting means take a long time to assemble and to disassemble and represent a significant weight.

SUMMARY OF THE INVENTION

According to the invention there is provided a rotor arrangement comprising a succession of disks carrying blades and joined by spacer pieces, wherein two of the disks, at opposite ends of the succession, are provided with extensions, wherein the extensions are tapered to meet at joined flanges, each disk being provided with axially spaced annular ledges, the spacer pieces comprising axially spaced annular rims, each rim engaging an associated ledge, and the disks and the rims comprising co-operating arrays of claw-coupling teeth and recesses for receiving said teeth and extending around the rims.

This arrangement therefore concerns the connection between the disks and the spacer pieces: the spacer pieces are now rigid pieces tasked with holding the intermediate disks and provided with means for centering the connection about the axis of the rotor and means for preventing rotation collaborating with complementary means situated on these disks. The bolted connections between the disks can therefore disappear, as can the connections of the intermediate disks to the central structure of the rotor: the intermediate disks are therefore suspended from the spacer pieces.

Although the resulting assembly may seem loose, it is rather more rigid than the known methods of assembly. One reason is undoubtedly the fact that the bolts hitherto used were relatively few in number, whereas the claw-coupling teeth may, according to an important embodiment of the invention, correspond to ends of the blade roots engaged in individual slots in the disks which pass through the disk, these ends protruding from the slots. The claw-coupling connection therefore has recourse to a great many teeth, without the arrangement being complicated thereby, since it involves no additional parts and simply requires extending the blade roots by comparison with prior practice.

The arrangement according to the invention is therefore a single and compact structure which can be joined to the central structure of the rotor by a single bolted flange. In addition, the continuations of the end disks may also be joined by an array of claw-coupling teeth and of recesses for said teeth so as to give a more rigid connection directly between the end disks.

DESCRIPTION OF THE PREFERRED EMBODIMENTS

Figure 1:
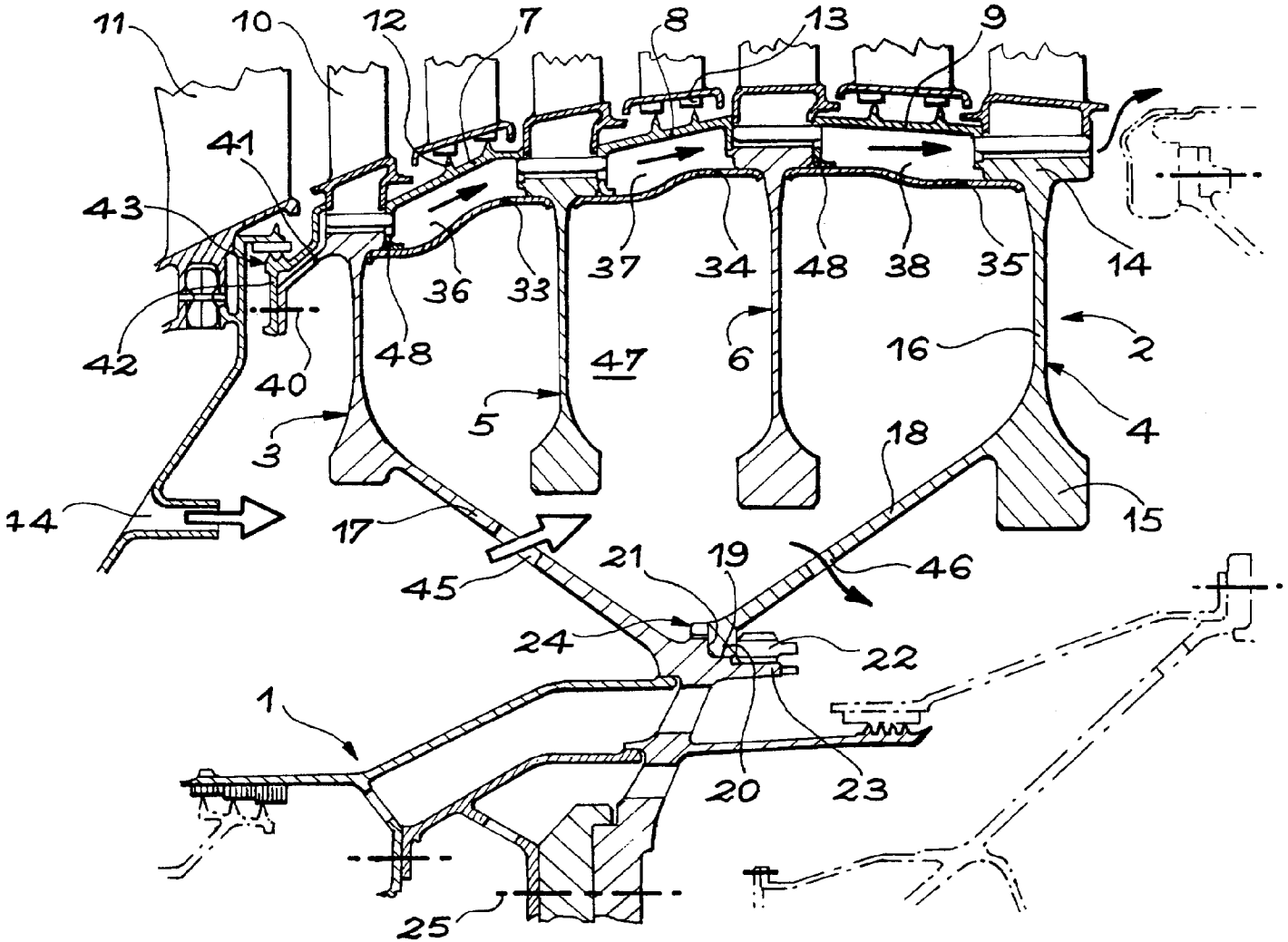
FIG. 1 is a view of a first embodiment of the invention showing a rotor of a turbomachine formed by a central structure carrying a disk assembly.

Referring first to FIG. 1, the rotor comprises a central structure 1 of known type usually, in many known turbomachines, made of elements assembled by bolting that will not be described in detail. The disk assembly bears the overall reference 2 and extends around a portion of the central structure 1. The main components of the disk assembly are upstream and downstream end disks 3 and 4, two intermediate disks 5 and 6, situated between the previous end disks 3, 4, and three spacer pieces 7, 8 and 9 connecting the disks (3 and 5, 5 and 6 and 6 and 4, respectively) in successive pairs. The disks 3, 4, 5 and 6 are more or less flat, parallel to one another and arranged in axially spaced succession. The disks 3, 4, 5 and 6 are all intended to carry rotor-blade stages 10 to extend into a stream of gases with each rotor blade stage 10 being arranged between respective stator-blade stages 11. The spacer pieces 7, 8 and 9 carry respective wipers 12, in the form of annular crests that engage respective rings of abradable material 13 extending around the stator-blade stages 11 to form labyrinth seals that make it difficult for gases to circumvent the stator blades 11 and produce losses of efficiency to flow. As all these details are well known, they will not be given a fuller description.

The upstream and downstream end disks 3 and 4 each comprise an outer ring 14, an inner ring 15 and a web 16 joining the two rings. An extension 17 extends from the ring 15 of the upstream end disk 3 and an extension 18 extends from the ring 15 of the downstream end disk 18. The extensions 17, 18 extend radially inwardly with a tapered conical shape. The two extensions 17 and 18 converge towards one another with the extension 18 of the downstream end disk 4 comprising an end ring 19 that engages a circular bearing surface 20 provided on the extension 17 of the upstream end disk 3 and rests against an abutment face 21 of this extension 17. A nut 22 is screwed onto a threaded face 23 of the extension 17, with the face 23 extending beyond the bearing surface 20, to hold the ring 19 against the abutment face 21. In addition, the ring 19 and the extension 17 are equipped with teeth which nest into intermediate recesses to form a circular claw coupling 24. This connection allows the disks 3 and 4 to be held firmly in an immovable position relative to one another. The extension 17 continues beyond the bearing surface 20 towards the center of the rotor and is joined to the central structure 1 via an arrangement of bolted flanges 25.

The intermediate disks 5 and 6 have no such inward extensions and are therefore connected directly neither to the other disks nor to the central structure 1 of the rotor. They are supported only by the spacer pieces 7, 8 and 9 by means of joints which will now be described with reference to FIG. 2.

Figure 2:
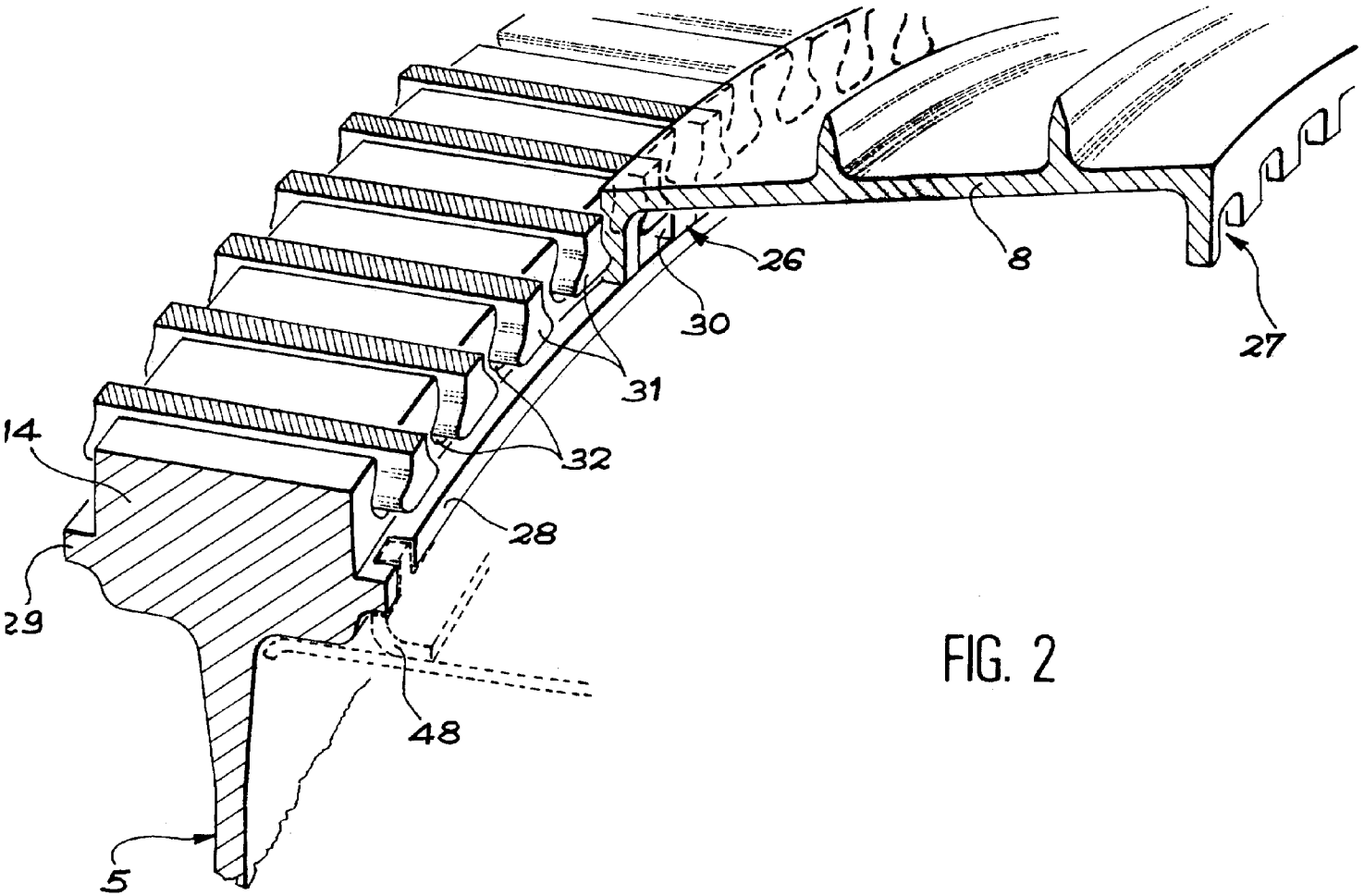
FIG. 2 is a perspective view of part of the assembly of FIG. 1 showing the connection of a spacer piece of the assembly to a disk of the assembly.

The spacer pieces 7, 8 and 9 are each provided with two flat rims 26 and 27 which extend radially inwardly from respective opposite ends of the associated spacer piece 7, 8, 9. The flat rims 26, 27 rest on axially extending annular ledges 28 and 29 of the pair of disks 3, 4, 5 and 6 separated by the associated spacer piece 7, 8, 9; one ledge 28 being provided on one disk and the other ledge 29 on the other disk. The rims 26 and 27 are equipped with respective recesses 30 with each recess 30 receiving a respective end of a root 31 of a rotor blade 10. The arrangement often used for assembling rotor blades to a disk consists in making slots 32 through an outer ring of the disk in an axial or oblique direction. The cross section of each slot 32 is bulbous, dovetail, Christmas tree or similar shape, opening to the outside of the disk via a narrow neck to retain a rotor blade root. In the present arrangement, the roots 31 are lengthened at part of their cross section and protrude from the slots 32 as seen in FIG. 2. It is also noted that there is no specific means for preventing the roots 31 from sliding in the slots 32, this function being effected by the rims 26 and 27 whose outer faces butt against the lateral faces of the outer rings 14 and therefore prevent the rotor blades 10 from moving by barring a portion of the slots 32 which is occupied by non-lengthening portions of the roots 31.

Screwing the nut 22 onto the threaded face 23 maintains cohesion of the assembly in the axial direction by clamping together the disks from 3, 4, 5, 6 with the intermediate spacer pieces 7, 8, 9 via the rims 26 and 27. They are centered by the engagement of the rims 26 and 27 against the ledges 28 and 29 in a radial direction. Finally, relative rotation is prevented by the claw couplings formed the teeth provided by the lengthened ends of the roots 31 of the rotor blades 10 and the corresponding recesses 30 of the rims 26 and 27, which give the assembly better torsional rigidity. The claw coupling 24 formed between the extensions 17 and 18 of the upstream and downstream end disks 3 and 4 has the benefit of establishing a direct anti-rotation connection between the end disks 3 and 4 and therefore also contributes to the torsional rigidity. This claw coupling 24 is not, however, always necessary because of the claw couplings that exist at the joints between the disks 3, 4, 5, 6 and the spacer pieces 7 to 9. If it is present, then it may contribute to making the assembly statically redundant, and it may then be advisable to eliminate one of the other claw couplings, for example one of those involving the central spacer piece 8.

Returning to FIG. 1, it can be seen that the assembly is supplemented by three shell rings 33, 34 and 35. Each shell ring 33, 34, 35 extends between an associated pair of disks 3, 4, 5, 6 and is radially inwardly of and concentric with an associated spacer piece 7, 8 and 9, to define associated chambers 36, 37 and 38 for the passage of ventilation air that also passes through unoccupied portions of the slots 32. The ventilation air is led in through ducts 40 formed between a flange 41 of the upstream disk 3 and an additional spacer piece 42, associated with another labyrinth seal 43 upstream of the disk 3. This ventilation air is led out to the gas stream after passing through the slots 32 of the downstream disk 4. The reference 44 denotes a passage admitting ventilation air to the assembly and drillings 45 and 46 are made in the extensions 17 and 18 of the end disks 3 and 4 to allow the ventilation air to cool a chamber 47 inside the assembly 2, particularly the intermediate disks 5 and 6. Each shell ring 33 to 35 comprises, at one end thereof, lugs 48 which extend radially outwardly from the associated shell ring 33, 34, 35 and enter notches made in the ledge 28 of the associated disk. They are thus prevented from rotating.

Figure 3:
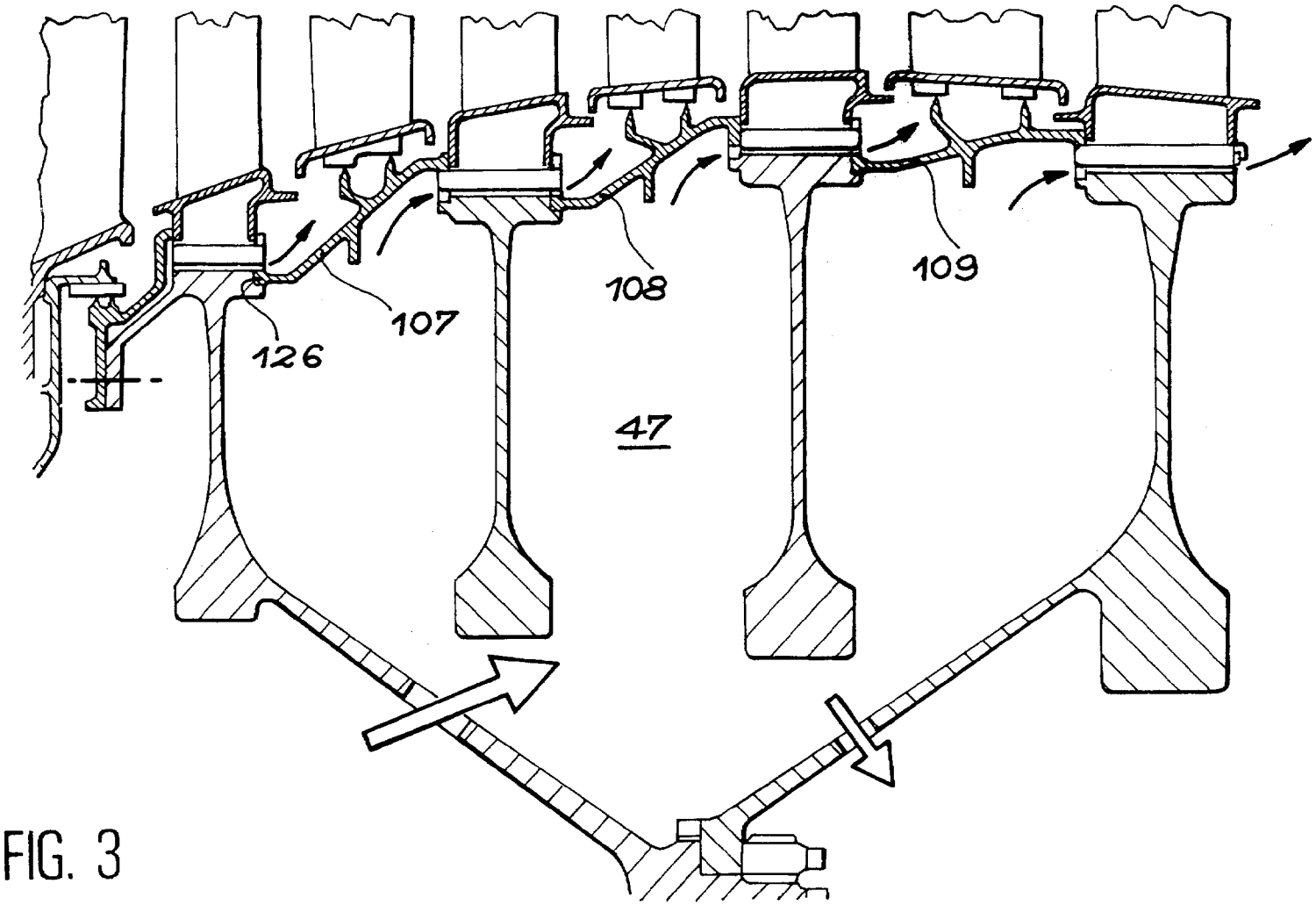
FIG. 3 is a similar view to FIG. 1 but sharing an alternative form of the assembly.

FIG. 3 illustrates a slightly different arrangement in which the shell rings 33 to 35 are omitted as are the separate chambers 36 to 38. The ventilation air flow passing through the slots 32 flows directly into the gas stream. The spacer pieces 7, 8 and 9 of FIGS. 1 and 2 are replaced by spacer pieces 107, 108 and 109 which resemble them but in each of which the upstream rim is replaced by an inverted rim 126, extending outward from the main portion of the spacer piece. The principles and the advantages of the assembly remain unchanged: in particular, the rims 126 continue to press against the ledges 28 and comprise recesses 30 for the receipt of extended ends of the roots 31 of the blades, so as to establish claw-coupling connections, and they comprise portions restraining the roots against sliding movements.

It should be added that the assembly of the rotor arrangement 2 is very simple to do because it consists in stacking the disks, spacer pieces and shell rings in succession and in tightening the single nut 22 when the extensions 17 and 19 of the end disks 3 and 4 have met.

We claim:

1. A rotor arrangement comprising a succession of disks carrying blades and joined by spacer pieces, wherein two of the disks, at opposite ends of the succession, are provided with extensions, wherein the extensions are tapered to meet at joined flanges, wherein said succession comprises at least one intermediary disk between said two disks, said at least one intermediary disk being suspended from at least one of said spacer pieces.

2. The arrangement as claimed in claim 1, wherein the extensions are joined by an array of claw-coupling teeth and recesses for said extension teeth.

3. The arrangement as claimed in claim 1, wherein each disk is provided with axially spaced annular ledges.

4. The arrangement as claimed in claim 3, wherein the spacer pieces comprise axially spaced annular rims.

5. The arrangement as claimed in claim 4, wherein one of the spacer pieces comprises a claw coupling to just one of the rims.

6. The arrangement as claimed in claim 4, wherein the rims on the spacer pieces extend radially inwardly, and a shell ring extends between each adjacent pair of rings, concentric with the associated spacer piece, and each shell ring and the associated spacer piece form a ventilation chamber into which the slots of the associated disks open.

7. The arrangement as claimed in claim 4, wherein the rims of each spacer piece extend one radially inwardly and the other radially outwardly.

8. The arrangement as claimed in claim 4, wherein each rim engages an associated ledge.

9. The arrangement as claimed in claim 8, wherein the disks and the rims comprise co-operating arrays of claw-coupling teeth and recesses for receiving said teeth and extending around the rims.

10. The arrangement as claimed in claim 9, wherein blade roots are engaged in individual slots in the disks and pass through the disks, the teeth being formed by ends of the blade roots protruding from the slots.

11. The arrangement as claimed in claim 1, wherein said succession comprises a plurality of intermediary disks between said two disks, each of said intermediary disks being suspended from at least one of said spacer pieces.

12. The arrangement as claimed in claim 11, wherein each of said intermediary disks is suspended from two of said spacer pieces.

13. The arrangement according to claim 1, wherein the spacer pieces comprise axially spaced annular rims, blade roots are engaged in individual slots in the disks and pass through the disks, and a shell ring forms a ventilation chamber together with at least one of the spacer pieces and a disk slot.

14. The arrangement as claimed in claim 13, wherein the rims on the spacer pieces extend radially inwardly.

15. The arrangement as claimed in claim 13, wherein said shell ring extends between each adjacent pair of rings.

16. The arrangement as claimed in claim 15, wherein said shell ring is concentric with the associated spacer piece.

17. The arrangement as claimed in claim 16, wherein the slots of the associated disks open into said ventilation chamber.

18. The arrangement according to claim 1, wherein the spacer pieces comprise axially spaced annular rims, and wherein at least one of said rims extends radially outwardly.

19. The arrangement as claimed in claim 18, wherein another of said rims extends radially inwardly.

20. A rotor arrangement comprising a succession of disks carrying blades and joined by spacer pieces, wherein two of the disks, at opposite ends of the succession, are provided with extensions, the extensions are tapered to meet at joined flanges, each disk is provided with axially spaced annular ledges, the spacer pieces comprise axially spaced annular rims, each rim engaging an associated ledge, the disks and the rims comprise co-operating arrays of claw-coupling teeth and recesses for receiving said teeth and extending around the rims, and the rims of each spacer piece extend one radially inwardly and the other radially outwardly.

21. A rotor arrangement comprising a succession of disks carrying blades and joined by spacer pieces, wherein two of the disks, at opposite ends of the succession, are provided with extensions, the extensions are tapered to meet at joined flanges, each disk being provided with axially spaced annular ledges, the spacer pieces comprise axially spaced annular rims, each rim engaging an associated ledge, the disks and the rims comprise co-operating arrays of claw-coupling teeth and recesses for receiving said teeth and extending around the rims, blade roots are engaged in individual slots in the disks and pass through the disks, the teeth being formed by ends of the blade roots protruding from the slots, the rims on the spacer pieces extend radially inwardly, a shell ring extends between each adjacent pair of rings, concentric with the associated spacer piece, and each shell ring and the associated spacer piece form a ventilation chamber into which the slots of the associated disks open.

* * * * *